US010710091B2

(12) United States Patent
Klem et al.

(10) Patent No.: US 10,710,091 B2
(45) Date of Patent: Jul. 14, 2020

(54) DISPOSAL APPARATUS, DISPOSAL SYSTEM AND METHOD FOR DISPOSING OF FOOD LEFTOVERS

(71) Applicant: MEIKO Maschinenbau GmbH & Co. KG, Offenburg (DE)

(72) Inventors: Peter Klem, Kehl-Marlen (DE); Thomas Peukert, Bühl (DE); Thomas Loos, Hohberg (DE)

(73) Assignee: MEIKO MASCHINENBAU GMBH & CO. KG, Offenburg (DE)

( * ) Notice: Subject to any disclaimer, the term of this patent is extended or adjusted under 35 U.S.C. 154(b) by 536 days.

(21) Appl. No.: 15/304,056

(22) PCT Filed: Apr. 15, 2015

(86) PCT No.: PCT/EP2015/058120
§ 371 (c)(1),
(2) Date: Oct. 13, 2016

(87) PCT Pub. No.: WO2015/158746
PCT Pub. Date: Oct. 22, 2015

(65) Prior Publication Data

US 2017/0028405 A1 Feb. 2, 2017

(30) Foreign Application Priority Data

Apr. 17, 2014 (DE) ..... 10 2014 207 411

(51) Int. Cl.
*B02C 13/04* (2006.01)
*B02C 23/38* (2006.01)
(Continued)

(52) U.S. Cl.
CPC ..... *B02C 13/04* (2013.01); *B02C 13/10* (2013.01); *B02C 23/16* (2013.01); *B02C 23/38* (2013.01);
(Continued)

(58) Field of Classification Search
CPC ..... B02C 13/04; B02C 13/10; B02C 23/38; B02C 23/16; B02C 13/16;
(Continued)

(56) References Cited

U.S. PATENT DOCUMENTS 3,356,016 A * 12/1967 Eidal ..... B02C 13/1835 100/140
4,570,863 A * 2/1986 Knox, Jr. ..... B02C 23/36 241/33
(Continued)

FOREIGN PATENT DOCUMENTS

DE 10 24 781 2/1958
DE 7 53 96 49 U1 8/1976
(Continued)

OTHER PUBLICATIONS

Koga, 2001, JP 2001070817 Translation.*
(Continued)

*Primary Examiner* — Adam J Eiseman
*Assistant Examiner* — Bobby Yeonjin Kim
(74) *Attorney, Agent, or Firm* — Foley & Lardner LLP

(57) ABSTRACT

A proposal is made for a disposal apparatus for disposing of food leftovers. The disposal apparatus comprises at least one comminuter, which has at least one grinding chamber and at least one collecting chamber. The grinding chamber is connected to the collecting chamber via one or more openings. At least one comminuting device having at least one impact tool for comminuting the food leftovers is arranged in the grinding chamber. In addition, at least one mixing device for generating a movement in the food leftovers is arranged in the grinding chamber. A method for disposing of food leftovers is furthermore proposed.

17 Claims, 4 Drawing Sheets

(51) Int. Cl.
*B02C 13/10* (2006.01)
*B02C 23/16* (2006.01)
*B02C 13/28* (2006.01)

(52) U.S. Cl.
CPC *B02C 2013/2816* (2013.01); *B02C 2023/165* (2013.01); *B02C 2201/06* (2013.01)

(58) Field of Classification Search
CPC .. B02C 2013/28609; B02C 2013/2816; B02C 2018/162; B02C 18/2216; B02C 2023/165; B02C 2201/06; B02C 18/062; B02C 18/0092; B02C 18/0084
USPC ..... 241/196, 73, 74, 101.8
See application file for complete search history.

(56) References Cited

U.S. PATENT DOCUMENTS

| | | | | |
|---|---|---|---|---|
| 5,143,306 | A * | 9/1992 | Nilsson | A47L 15/4204 241/46.012 |
| 7,954,739 | B2 * | 6/2011 | Shin-Ya | B02C 18/0084 241/100 |
| 2003/0201220 | A1 | 10/2003 | Peter et al. | |
| 2008/0302890 | A1 * | 12/2008 | Misawa | B02C 18/0092 241/46.013 |
| 2010/0193618 | A1 * | 8/2010 | Lewis-Gray | B02C 21/02 241/77 |
| 2010/0276526 | A1 | 11/2010 | Shin-Ya | |
| 2013/0183426 | A1 * | 7/2013 | Ledger | A47J 43/042 426/519 |
| 2016/0228879 | A1 * | 8/2016 | Scharfe | B02C 13/16 |

FOREIGN PATENT DOCUMENTS

| | | | | |
|---|---|---|---|---|
| DE | 43 00 784 | A1 | 7/1994 | |
| DE | 295 14 167 | U1 | 12/1995 | |
| DE | 20 2011 108424 | U1 | 3/2012 | |
| EP | 1 253 094 | A1 | 10/2002 | |
| JP | 2001070817 | A * | 3/2001 | B30B 9/128 |
| JP | 2008-114149 | | 5/2008 | |
| JP | 2008114149-e03cA | * | 5/2008 | E03C 1/2665 |
| KR | 10-0785850 | B1 | 12/2007 | |
| WO | WO 2012/034917 | A1 | 3/2012 | |

OTHER PUBLICATIONS

Ishida, 2008, JP 2008114149 Translation.*
InSinkErator, InSinkErator Waste XPress Pulper Systems, https://www.youtube.com/watch?v=Ck5vmCkK970&t=159s (Year: 2009).*
Office Action issued in co-pending Chinese Patent Application No. 2015800324060, dated Mar. 23, 2018.
International Search Report and Written Opinion issued in related International Patent Application No. PCT/EP2015/058120, completed Jun. 10, 2015.
Office Action issued in related German Patent Application No. 10 2014 207 411.8, dated Dec. 5, 2014.
International Preliminary Report on Patentability issued in related International Patent Application No. PCT/EP2015/058120, completed Oct. 27, 2016.
Section 3.2.4 and 3.2.5 of text book entitled "*Engineering of Inorganic Nonmetallic Materials Technology*," vol. 4 (Published Dec. 2013), pp. 39-40.
Office Action issued in co-pending Chinese Patent Application No. 2015800324060, dated Nov. 21, 2018.

* cited by examiner

DISPOSAL APPARATUS, DISPOSAL SYSTEM AND METHOD FOR DISPOSING OF FOOD LEFTOVERS

FIELD OF THE INVENTION

The invention relates to a disposal apparatus, a disposal system and a method for disposing of food leftovers. Disposal apparatuses, disposal systems and methods of this kind are used especially in large kitchens or other kitchens involved in communal catering, e.g. in restaurants, company canteens, government facilities, hospitals and care facilities, schools, pubs or other establishments in which communal catering is carried out. However, other areas of use are also possible, in principle. In particular, use in smaller kitchens for communal catering, e.g. in smaller restaurants, is possible within the scope of the present invention.

PRIOR ART

In many communal catering facilities, e.g. the large kitchens mentioned above, waste arises both in the preparation of meals and in the cleaning of crockery, said waste being referred to below as "food leftovers". The disposal of these food leftovers is the subject matter of the present invention. The food leftovers, which are usually in solid or in liquid form, can comprise, in particular, organic waste but can also comprise other types of waste. The boundary conditions for disposal are, in particular, adequate hygiene, minimum effort for the personnel, minimum overall costs and a small space requirement.

Various systems and procedures for disposing of food leftovers are known from the prior art. The simplest variant is the collection of food leftovers at the point where they arise in buckets or other receptacles, manual or automatic transfer of these receptacles, emptying into larger receptacles, especially in a refrigerated room, and emptying or collection of the large receptacles by a disposal agent.

In an alternative variant, the food leftovers are thrown into gutters at the point where they arise, and the food leftovers are then automatically carried through pipes to a central point, e.g. in the cellar of a building, with the aid of water. At this central collection point, the water is generally removed from the food leftovers and they are then stored temporarily as a relatively dry substrate in a receptacle, generally likewise in a refrigerated room, before they are collected by a disposal agent.

One or more workstations can be linked to the system at their discharge points. In addition to the removal of water, process steps for the separation of fats or for comminuting the food leftovers can also be incorporated into the sequence, and/or corresponding devices can be provided centrally. The disposal agent can burn or dump the food leftovers or take them to a biogas plant, for example.

In another variant, the food leftovers are put into a deposition station and are extracted from that automatically by means of a vacuum system, fed to a comminuter by means of pipes and then stored temporarily as a viscous mass in a collecting tank. Systems of this kind do not generally require a refrigerated room since they are usually hermetically sealed. The collecting tank can be emptied periodically by means of a tanker truck, and the viscous mass can be taken to a biogas plant, for example. In this case too, several workstations can be linked to the system at their deposition stations.

Thus, EP 1 253 094 A1, for example, describes a garbage disposal system for wet garbage, in particular for waste from large kitchens. The wet waste is transported from decentralized deposition stations to a central discharge device by compressed air or a vacuum. There, a collecting hopper in the form of a screen is provided, from which liquid flows to the outside to an outer collecting region and is drained off at intervals. The remaining wet garbage has thus largely been dewatered already when it is fed to further processing, e.g. to a comminution plant and a dewatering press, before it is passed to a silo for food leftovers, for example.

Waste compactors which compact waste are furthermore known from the prior art. WO 2012/034917 A1, for example, describes a waste compactor which comprises at least one sturdy screw conveyor that slopes and converges in a downward direction. The screw conveyor is arranged in a funnel-shaped housing, which has an outlet opening at the lower end thereof.

Comminuting devices in which radially arranged chains are rotated about an axis in a housing are furthermore known from the prior art. DE 4300784 A1, for example, describes a method for breaking down appliances for disposal that contain rigid foam or rigid plastics, in particular for emission-free recovery of fluorocarbons from polyurethane foam insulation and other constituents, in particular from cooling appliances and refrigerators. In this method, the rigid foam or rigid plastics are comminuted together with the other parts of the appliance in a comminuting device. Comminution takes place in a chamber that is sealed with respect to the environment. The comminuting device operates by means of the mill system, wherein comminution is accomplished, inter alia, by movement of the materials to be ground relative to one another, and wherein essentially the following method steps are performed: a) filling of the comminuting device with the material to be ground; b) rendering the interior of the comminuting device inert; c) grinding the material to be comminuted; d) evacuation of the inert gas and of gases that form during grinding; e) discharging the comminuted ground material. The comminuting device can have rotating chains, for example.

In a similar way, U.S. Pat. No. 3,356,016 B describes a comminuting device for scrap. Inter alia, this comprises a rotating chopper unit and a hammer mill. The chopper unit can have rotating chains, for example.

DE 7539649 U1 describes an apparatus for treating waste, in particular for erection at the location where the waste is produced. The apparatus comprises a receiving device for the waste, a conveying and comminuting device and a control device. A charging box is arranged on a horizontal frame to receive the waste. Within the box, the conveying device comprises at least one chain with pushers, which runs over a sprocket on a drive shaft and a freely rotating sprocket on a horizontally adjustable axle. The comminuting device is formed by the moving pushers and fixed blades on the inside of the housing at the discharge end of the chain.

DE 295 14 167 U1 discloses a comminuter for solid and pasty waste in a liquid, comprising a housing with rotating cutting elements therein, which are connected to a rotary drive. Food leftovers and foodstuff residues but also waste such as plastic components and aluminum caps are mentioned as examples of waste.

JP 2008-114 149 A discloses a disposal apparatus which is suitable for disposing of food leftovers. A description is given of a cylindrically shaped disposal apparatus, wherein water is added. The disposal apparatus comprises an apparatus for generating a circulating flow of the water added and a rotating comminuting device comprising a rotating and a rigid element. Consequently, food leftovers pass through the comminuting device several times.

US 2010/0 276 526 A1 discloses an apparatus for disposing of waste which comprises a comminuting unit, an apparatus for dehydration and an apparatus for drying. The disposal apparatus is suitable for disposing of food leftovers. The comminuting unit has a rotating blade and a shredder with axes rotating in parallel.

However, in practice, the disposal apparatuses known from the prior art exhibit a number of technical challenges. Thus, the first of the abovementioned variants, comprising manual disposal of food leftovers, is unhygienic and laborious in practice, and the emptying and preparation of the receptacles tie up personnel.

Automated devices, in contrast, are comparatively complex and require a relatively large amount of space. However, the main components of the system can also be outside the actual working area. Disposal apparatuses with water flushing channels have the disadvantage that water is initially required for transfer and then has to be removed again from the waste at the end of the process, this being expensive. Moreover, apparatuses of this kind are also of relatively open design, and therefore odors which can propagate throughout the entire working environment can easily form. In addition, collecting receptacles must generally be accommodated in a cooled chamber.

In the case of transfer in pipes by means of a vacuum, a closed system is generally required, and therefore hygiene and the avoidance of odors are relatively easy to manage. In practice, however, the disadvantages here are a relatively high outlay on apparatus and high operating costs.

Greater scarcity of resources, especially an increasingly noticeable lack of personnel in kitchens as well as restricted space conditions are furthermore increasingly necessitating hygienic, uncomplicated and low-cost disposal of organic waste, even in relatively small kitchens. Many smaller kitchens would use an automatic disposal system but the high investment that is generally required often prevents its use precisely in relatively small businesses.

Another technical challenge is that high-value biological material or substrate is increasingly being used for energy generation in practice. It can be assumed that trading biological material for biogas plants will be of interest financially in the future, even for small businesses. Disposal devices must therefore meet the demands for the production of substrate for such biogas plants.

OBJECT OF THE INVENTION

It is therefore the object of the present invention to provide a disposal apparatus, a disposal system and a method for disposing of food leftovers which at least to a large extent avoid the disadvantages of known apparatuses and methods. In particular, the intention is to provide a low-cost and compact disposal apparatus which can be used even in relatively small establishments and which allows the production of biological material for biogas plants from food leftovers in a simple, low-maintenance and low-cost manner.

DISCLOSURE OF THE INVENTION

This object is achieved by a disposal apparatus, a disposal system and a method for disposing of food leftovers having the features of the independent patent claims. Advantageous developments, which can be implemented individually or in any desired combination, are presented in the dependent claims.

In the text which follows, the terms "have", "exhibit", "comprise" or "include" or any other grammatical derivations thereof are used in a nonexclusive sense. Accordingly, these terms can refer both to situations in which there are no further features in addition to the features introduced by these terms or to situations in which one or more further features is/are present.

For example, the expression "A has B", "A exhibits B", "A comprises B" or "A includes B" can refer to the situation in which there is no further element in A apart from B (i.e. to a situation in which A consists exclusively of B) or to the situation in which one or more further elements is/are present in A in addition to B, e.g. element C, elements C and D or even further elements.

Attention is furthermore drawn to the fact that the terms "at least one" and "one or more" and grammatical variations of these terms or similar terms, when used in connection with one or more elements or features and when intended to express the fact that a single or multiple instance of said element or feature can be provided, are generally used only once, e.g. when the feature or element is first introduced. When the feature or element is subsequently mentioned again, the corresponding term "at least one" or "one or more" is generally no longer used, without excluding the possibility that a single or multiple instance of the feature or element can be provided.

The terms "preferably", "in particular", "for example" or similar terms are furthermore used below in connection with optional features without thereby excluding alternative embodiments. Thus, features which are introduced by these terms are optional features, and there is no intention to restrict the scope of protection of the claims and, in particular, the independent claims by these features. Thus, as a person skilled in the art will recognize, the invention can also be carried out using other embodiments. In a similar way, features which are introduced by "in one embodiment of the invention" or by "in one illustrative embodiment of the invention" are interpreted as optional features without thereby excluding alternative embodiments or restricting the scope of protection of the independent claims. Moreover, these introductory expressions shall not affect any possible ways of combining the features introduced thereby with other features, whether these be optional or non-optional features.

In a first aspect of the present invention, a disposal apparatus for disposing of food leftovers is proposed. In the context of the present invention, "food leftovers" should in general be taken to mean materials and objects which may arise during the preparation or serving of food and drink and/or which may remain as leftovers after the consumption of food or drink. In particular, the food leftovers can consist completely of organic materials or at least comprise organic materials. In principle, the food leftovers can be in solid or pasty form.

"Disposal of food leftovers" should fundamentally be taken to mean any action which comprises storage, preparation, stocking, removal, destruction or conversion of the food leftovers or a combination of the actions mentioned. In particular, disposal can comprise comminution, compaction or separation of the food leftovers. In the context of the present invention, disposal can comprise comminution in particular, as will be explained in greater detail below. In the context of the present invention, "comminution" should in general be taken to mean a reduction in size of the food leftovers by appropriate processing, in particular mechanical processing. Thus, for example, food leftovers, in particular solid food leftovers, can in practice have a volume of, in some cases, several cubic centimeters, e.g. more than 5 or more than 10 $cm^3$. In the context of comminution, a reduction in this volume to less than 2 $cm^3$, in particular less than 1 $cm^3$, can take place, for example, with the result that only food leftovers containing solid particles with a maximum size of 2 $cm^3$, in particular 1 $cm^3$, are present after comminution, for example. However, other kinds of comminution are conceivable, in principle.

The disposal apparatus comprises at least one comminuter. A comminuting device is fundamentally any apparatus designed to carry out comminution of the food leftovers according to the above definition. In particular, the comminuting device can be designed to comminute the food leftovers in such a way that solid constituents of the food leftovers have a size of no more than 2 $cm^3$, preferably no more than 1 $cm^3$, after comminution. In practice, such comminution involves easier removal and disposal of the food leftovers comminuted in this way since, for example, food leftovers comminuted in this way can be removed via pumps, hoses or pipes, in contrast to large, uncomminuted food leftovers.

The comminuter has at least one grinding chamber and at least one collecting chamber. The grinding chamber is connected to the collecting chamber via one or more openings. In particular, these openings can be arranged in such a way that comminuted food leftovers can pass into the collecting chamber through the openings, e.g. through holes in a grinding chamber wall. In the context of the present invention, a "grinding chamber" should fundamentally be understood to be any chamber in which comminution, in particular grinding, of the food leftovers can take place. In the context of the present invention, a "collecting chamber" should fundamentally be understood to be any chamber in which comminuted food leftovers can be collected and/or temporarily stored. For example, the grinding chamber can have a volume of 1 l to 1000 l, in particular a volume of 10 l to 100 l and particularly preferably a volume of 20 l to 80 l, e.g. 40 l. The collecting chamber can likewise have a volume of 1 l to 1000 l, for example, in particular a volume of 10 l to 100 l and particularly preferably a volume of 20 l to 80 l, e.g. 40 l. Attention is drawn to the fact that other dimensions are also possible, however.

At least one comminuting device having at least one impact tool for comminuting the food leftovers is arranged in the grinding chamber. A "comminuting device" should fundamentally be understood to be any apparatus which, as part of the comminuter, can carry out the actual comminuting process in the sense of the above definition of the term "comminution". In particular, the comminuting device can comprise a grinding mechanism. In the context of the present invention, an "impact tool" for comminuting the food leftovers should fundamentally be taken to be any tool which can comminute the food leftovers through mechanical action, in particular by impacts. In particular, as explained in greater detail below, the impact tool can comprise a plurality of impact elements, which can be set in a state of motion, e.g. rotation, and which can then transfer their kinetic energy partially to the food leftovers when they strike the food leftovers and can thus bring about comminution of the food leftovers.

At least one mixing device for generating a movement in the food leftovers is furthermore arranged in the grinding chamber. Thus, a "mixing device" should fundamentally be understood to be any apparatus designed to impart movement to and/or mix the food leftovers. In particular, the mixing device can be designed to generate a continuous or discontinuous flow within the food leftovers, in particular within fully or partially comminuted food leftovers. Accordingly, as explained in greater detail below, the mixing device can be designed fully or partially as a fluid flow device. As explained above, the disposal apparatus comprises at least one impact tool and at least one mixing device. The mixing device and the impact tool are both arranged within the grinding chamber. As a particularly preferred option, the impact tool and the mixing device are formed separately from one another, allowing mixing to take place independently of comminution. The impact tool and the mixing device can be driven by one drive or, alternatively, by a plurality of independent drives, for example. Thus, the movement of the mixing device can be coupled directly or via a step-up or step-down transmission to a movement of the comminuting device, in particular of the impact tool, or can also be designed to be completely independent of the movement thereof.

As explained above, it is possible, in particular for the impact tool to have a plurality of impact elements, also referred to as impact members. In particular, the impact tool can have at least a plurality of impact members connected to one another in an articulated manner. In particular, the impact tool can have at least one chain.

In particular, the impact tool can have chains that are each connected at one end to at least one drive axle. In particular, the drive axle can comprise one or more drive shafts. During rotation, the chains can extend radially outward from the drive axle, for example. In particular, the impact tool can have two chains arranged on mutually opposite sides and connected to the drive axle. As an alternative or in addition, the chains and/or the impact tools can also be connected to the drive axle in some other way, preferably in an arrangement which prevents an unbalance of the impact tool through an appropriate equilibrium of the centrifugal forces which occur.

As explained above, it is possible, in particular, for the impact tool to rotate around at least one drive axle.

In particular, the comminuting device can have at least one drive axle and at least one drive, wherein a "drive" should fundamentally be understood to be any apparatus which is designed to drive the drive axle, in particular to impart rotation thereto. In particular, the drive can be designed to impart a rotation of at least 500 to 2000 rpm and particularly preferably a rotation of 1000 rpm to the drive axle.

In particular, the drive can have at least one toothed belt drive and/or at least one V-belt drive. As an alternative or in addition, however, other types of drive are also possible, e.g. gear mechanisms or similar. In particular, the drive can comprise a drive disk arranged outside the grinding chamber, in particular a belt pulley, which can be connected to the drive axle. The drive can furthermore comprise at least one drive motor arranged outside the grinding chamber, said drive motor being connected to the drive axle by at least one transmission, for example. For example, the drive motor can be connected to the drive axle by at least one toothed belt drive, at least one V-belt drive and/or at least one gear mechanism in order to drive the drive axle.

In particular, the drive axle can pass through a grinding chamber wall of the grinding chamber. For example, at least one through hole can be provided at a point where the drive axle passes through a grinding chamber wall of the grinding chamber, e.g. a plate which forms the grinding chamber wall at this point. The through hole can be sealed by at least one seal, for example.

As explained above, it is possible, in particular, for the comminuting device and the mixing device to be driven by a common drive, e.g. by a common drive having the abovementioned at least one drive motor outside the grinding chamber. The drive can be performed in such a way that a movement of the comminuting device is coupled to the movement of the mixing device and/or vice versa. The drive can take place with a constant transmission ratio or, alternatively, with a reduction or a speed increase. The drive can furthermore take place in the same direction or in opposite directions. By way of example, the impact tool and the mixing device can be arranged axially spaced apart on a drive axle driven by the drive, for example.

As explained above, it is possible, in particular, for the mixing device to be designed to generate at least one flow in the food leftovers. In particular, the mixing device can have at least one blade, preferably at least two or at least three blades. Thus, for example, the mixing device can comprise at least one blade wheel. In particular, the blades can be mounted so as to be rotatable about a drive axle, e.g. the abovementioned drive axle.

In particular, the mixing device can be designed to generate the movement in the food leftovers in a region of the openings, ensuring that comminuted food leftovers are guided to the openings by the movement and, for example, can pass through the openings into the collecting chamber. In this way, it is always possible, for example, to generate a movement such that fully or partially comminuted food leftovers are brought into the region of the openings after the above-described comminution, that is to say, for example, a region from which these comminuted food leftovers can pass through the openings. The mixing device can furthermore also be designed to generate a thrust and/or a suction within the food leftovers, with the result that the comminuted food leftovers are guided to the openings by this thrust and/or this suction.

In particular, the grinding chamber can be divided into one or more subchambers. Thus, the grinding chamber can be divided into at least one loading chamber and at least one fines chamber, for example. In principle, the loading chamber can serve to receive uncomminuted food leftovers, allowing uncomminuted food leftovers to be introduced directly or indirectly into this loading chamber, for example. The fines chamber can be designed to receive fully or partially comminuted food leftovers, for example. Thus, the grinding chamber can be divided into the at least one loading chamber and the at least one fines chamber in such a way, for example, that uncomminuted food leftovers, e.g. food leftovers above a maximum size or equivalent size, cannot enter the fines chamber from the loading chamber. For this purpose, it is possible, for example, to provide one or more divisions, with one or more appropriately dimensioned openings, which at least largely prevent passage of uncomminuted large food leftovers into the fines chamber. It is possible, in particular, for the at least one abovementioned opening, which connects the grinding chamber to the collecting chamber, in particular the plurality of openings, to be arranged in the region of the fines chamber, with the result that the comminuted food leftovers pass from the grinding chamber into the collecting chamber at least partially from the fines chamber. However, it is also possible for one or more openings to be arranged completely or partially in the region of the loading chamber since the loading chamber can already contain small or comminuted food leftovers, which can also pass directly from the loading chamber into the collecting chamber.

The comminuting device described above, in particular the abovementioned impact tool for comminuting the food leftovers, can be arranged in the loading chamber, in particular fully or partially therein, ensuring that comminution takes place fully or partially within the loading chamber. As an alternative or in addition, the comminuting device can also be arranged fully or partially between the loading chamber and the fines chamber.

The mixing device is preferably arranged fully or partially in the fines chamber. In this way, the above-described mixing and/or generation of a movement in the food leftovers can take place in the fines chamber, in particular fully or partially therein. Thus, for example, it is possible to generate in the fines chamber a flow along the at least one opening by means of the mixing device. However, it is also possible for the mixing device to be arranged fully or partially or even additionally within the loading chamber.

As explained above, the comminuter can have at least one separating device, which is designed to separate the loading chamber and the fines chamber. Thus, the separating device can be designed, for example, to allow only food leftovers of a predetermined maximum size, e.g. of a predetermined maximum diameter or equivalent diameter, to pass through, ensuring that only such food leftovers of the predetermined maximum size can pass from the loading chamber into the fines chamber. In particular, the separating device can comprise at least one separating disk and/or at least one screen, also referred to below as a separating screen. In this context, a "separating disk" should be understood to be a disk which, together with at least one further element, e.g. a wall of the grinding chamber, forms at least one gap and/or interspace, the width of which limits passage of comminuted food leftovers, for example. For example, a gap width of a gap, e.g. an annular gap, formed by the separating disk and a wall of the grinding chamber (also referred to as a grinding chamber wall) can define a maximum size of food leftovers which can pass from the loading chamber into the fines chamber. The separating disk can be mounted in a fixed manner or can also be mounted in a movable manner, being mounted so as to rotate, for example. However, other separating devices are also possible, in principle. In particular, the separating device can comprise at least one separating disk in accordance with the above definition arranged between the impact tool and the mixing device. For example, the impact tool, the mixing device and the separating device can be mounted on a common drive axle. For example, the separating device, in particular the separating disk, can be mounted between the impact tool and the mixing device, e.g. the blade wheel.

As explained above, the loading chamber is designed in such a way that uncomminuted food leftovers can be introduced directly or indirectly into this loading chamber. For example, the loading chamber can have at least one loading opening, via which the loading chamber can be loaded with uncomminuted food leftovers.

In particular, the fines chamber can be arranged in such a way relative to the loading chamber that comminuted food leftovers are moved from the loading chamber into the fines chamber under the action of gravity. In particular, comminuted food leftovers can slide under the action of gravity from the loading chamber into the fines chamber, e.g. through the abovementioned separating device. Thus, the fines chamber can be arranged at least partially under the loading chamber, for example. In particular, the grinding chamber can have an axis, e.g. an axis of symmetry and, in particular, a cylinder axis, wherein the axis slopes by an angle relative to a horizontal, for example. For example, this slope can be 5° to 70°, in particular 10° to 45°. In particular, the grinding chamber can have a circular, polygonal or oval cross section. In particular, the grinding chamber can have a cylinder shape or a drum shape. In particular, as explained above, the grinding chamber can have the shape of a sloping cylinder or cylinder section or the shape of a sloping drum, wherein the slope is preferably configured in such a way, as explained above, that comminuted food leftovers can fall and/or slide from the loading chamber into the fines chamber under the action of gravity. For this purpose, at least one sloping sliding surface can be provided in the grinding chamber, for example.

By way of example, a bottom of the grinding chamber can slope by an angle relative to a horizontal, in particular by an angle of 5° to 70°, preferably by an angle of 10° to 45°. By means of the slope of the bottom relative to the horizontal, it is possible, in turn, to ensure that comminuted food leftovers can slide from the loading chamber into the fines chamber. As an alternative or in addition, a plurality of slopes is also possible, for example, and therefore the bottom of the grinding chamber can also be configured fully or partially as a hopper and/or chute, for example.

As explained above, the grinding chamber has one or more openings, via which the grinding chamber is connected to the collecting chamber. Thus, for example, the grinding chamber can have at least one grinding chamber wall, wherein the one or more openings are arranged in the grinding chamber wall and allow comminuted food leftovers to cross from the grinding chamber to the collecting chamber. In particular, the openings can form a screen. In particular, the grinding chamber wall can be produced fully or partially from a metallic material, e.g. a steel sheet. As an alternative or in addition, however, other materials can also be used, e.g. plastics materials.

Further possible embodiments relate, in particular, to the at least one opening, i.e. the one or more openings, via which the grinding chamber is connected to the collecting chamber. In particular, the one or more openings can form at least one screen. In particular, the one or more openings can have a diameter or equivalent diameter 1 mm to 30 mm, preferably a diameter or equivalent diameter of 3 mm to 15 mm. Other dimensions are also possible in principle. In particular, the one or more openings can have a round cross section. As an alternative or in addition, one or more of the openings can also have other cross sections, e.g. a polygonal cross section and/or an oval cross section.

In particular, the at least one grinding chamber can have at least one door for carrying out maintenance work. Here, the term "door" should be understood in general to be at least one closable opening. By way of example, the door can have at least one closure device, chosen from a flap, a removable cover, a slide, a hood or some other type of closure device. In particular, the at least one door can have at least one seal, e.g. an encircling rubber seal. The seal can prevent liquid food leftovers from reaching the outside from the grinding chamber, for example. As an alternative or in addition, the seal can also be designed to prevent the escape of gases and/or odors from the grinding chamber.

As an alternative or in addition, the collecting chamber can also have at least one door for carrying out maintenance work. As regards the definition of the term "door" and/or as regards possible embodiments of the door, reference can be made to the description of the door of the grinding chamber. In particular, the door can once again have at least one seal. The door of the grinding chamber and the door of the collecting chamber can be designed as separate doors or can also be designed as a common door. Thus, for example, a common door that can be opened jointly to carry out maintenance work in the grinding chamber and/or in the collecting chamber can be provided.

In particular, the collecting chamber can have at least one opening for manual emptying. For example, this at least one opening for manual emptying can be provided on the bottom of the collecting chamber. The at least one opening can be closable by means of at least one closure, for example, e.g. at least one screw closure. Other types of closure can also be used.

The disposal apparatus can furthermore have at least one pump for pumping comminuted food leftovers out of the collecting chamber. For example, at least one opening can be provided in the collecting chamber and/or at least one connection piece can be provided in the collecting chamber, which is connected to a pump or can be connected to a pump. For example, at least one pump for pumping the comminuted food leftovers out of the collecting chamber can be part of the disposal apparatus.

The disposal apparatus can furthermore have at least one level sensor for detecting at least one level of comminuted food leftovers in the collecting chamber. In this case, it is possible in principle to use at least one level sensor of any kind, it being possible for this sensor to be based on one or more physical principles of measurement for detecting the level of the comminuted food leftovers in the collecting chamber. In particular, however, the level sensor can comprise at least one float switch. By way of example the float switch can float on the food leftovers and be raised together with the food leftovers. In general terms, the level sensor can be a digital level sensor or can also be designed to detect several levels, either continuously or in several stages.

The disposal apparatus can furthermore have at least one controller, which is designed to fully or partially control the disposal apparatus. In particular the controller can be designed to control at least the comminuter of the disposal apparatus. As an alternative or in addition, however, the controller can also be designed to control the abovementioned pump for pumping comminuted food leftovers out of the collecting chamber, for example.

Thus, for example, the controller can comprise at least one electronic controller and/or at least one data processing device which is designed to control one or more functions of the disposal apparatus. Here, a "controller" should fundamentally be understood to be any device designed to control one or more further devices in the disposal apparatus. By way of example, the controller can comprise at least one data processing device designed to perform one or more program sequences and/or designed to monitor one or more processes in the disposal apparatus. The controller can furthermore comprise at least one user interface designed to allow information and/or commands to be input by a user and/or designed to allow one or more items of information to be output to the user. For example, the user interface can comprise at least one operating element, e.g. a control panel and/or a keyboard. As an alternative or in addition, the user interface can comprise at least one display, for example. The controller can furthermore comprise at least one electronic interface, e.g. at least one wired and/or at least one wireless interface. Via the at least one electronic interface, information, data and/or commands can be transferred to the controller and/or transferred from the controller to some other device, e.g. another computer.

In addition to controlling the at least one comminuter, the controller can furthermore be designed to control and/or monitor one or more further elements of the disposal apparatus. For example, the at least one level sensor can transfer sensor data to the controller, e.g. in a wireless and/or wired manner. In general, the controller can be designed to monitor a filling level in the collecting chamber, for example.

Once again as an alternative or in addition, the controller can be designed to control and/or monitor pumping of comminuted food leftovers out of the collecting chamber, for example.

If the controller is designed to monitor a filling level in the collecting chamber, for example, this monitoring can include outputting corresponding information and/or warnings to a user of the disposal apparatus, for example. For example, a current filling level can be communicated to a user via at least one display and/or at least one other type of indicating device. As an alternative or in addition, one or more warning signals can be output, for example, if a filling level exceeds a predetermined maximum filling level.

Further possible embodiments relate to the embodiment of the collecting chamber of the disposal apparatus. Thus, for example, a bottom of the collecting chamber can slope toward a collecting point and/or collecting region. As an alternative or in addition, the bottom can also form a hopper, in part or in whole, for example. The collecting point or collecting region in the bottom of the collecting region can also be the point from which extraction of the food leftovers can take place, for example, e.g. by means of the at least one abovementioned pump for pumping the comminuted food leftovers out of the collecting chamber. Once again as an alternative or in addition, it is also possible for the at least one opening for manual emptying to be arranged at this collecting point or in this collecting region.

In particular, the collecting chamber can at least partially surround the grinding chamber. Thus, for example, the disposal apparatus can have a housing which forms the grinding chamber and the collecting chamber, wherein the collecting chamber at least partially surrounds the grinding chamber. For example, the collecting chamber can surround the grinding chamber in annular fashion, with the result that an interspace that forms the collecting chamber is provided in the housing between the grinding chamber and the housing wall. However, other embodiments are also possible in principle.

Overall, the comminuter can be arranged within a housing, in particular an external housing, of the disposal apparatus. Thus, the comminuter can have a comminuter housing which encloses the grinding chamber and the collecting chamber and which, in turn, is arranged within an external housing of the disposal apparatus. This housing or external housing can have at least one feed opening for feeding in food leftovers, for example, wherein the feed opening can be connected to the grinding chamber. The feed opening can comprise at least one feed hopper, for example. The feed opening can be connected to the grinding chamber by at least one chute and/or at least one pipe system, for example. In particular, the feed opening can be arranged in a work surface of the housing, in particular in an upper work surface and particularly preferably in a flat work surface. The feed opening can be arranged in a cover plate of the housing, for example. The housing can furthermore have a pedestal and/or some other type of stand which enables the disposal apparatus to be set up.

As explained above, the disposal apparatus can, in particular, be provided with a particularly small overall volume, thus allowing the disposal apparatus to be used even in relatively small kitchens. Thus, the housing can have a height of no more than 1.5 m, preferably no more than 1.0 m, for example. In particular, the disposal apparatus can accordingly be configured as a tabletop model or an undertable model, and therefore the maximum height thereof is that of a conventional work surface. In principle, however, any desired dimensions of the disposal apparatus are possible. Once again as an alternative or in addition, integration of the disposal apparatus into one or more larger disposal systems is also possible, e.g. into one or more of the abovementioned prior art disposal systems. Thus, the disposal apparatus can also be used as a component part of the system described in EP 1 253 094 A1, for example. Other areas of use are also possible.

In particular, the housing of the disposal apparatus, i.e. the external housing, can once again have at least one door. As regards a possible definition of the term "door" and as regards possible configurations of the door, reference may be made to the above description. In particular, the door can be configured in such a way that the comminuter can be accessed by opening the door. In particular, the door can have at least one removable panel, e.g. a removable front panel. As an alternative or in addition, however, the door can also be a door with a vertical hinge, for example, e.g. a door arranged on a front side which can be opened by means of the vertically aligned hinge. However, other embodiments of the door are also possible, in principle.

In a further aspect of the present invention, a disposal system for disposing of food leftovers is proposed. In the context of the present invention, a "disposal system" should be understood to be an apparatus which is made up of a plurality of components interconnected in a fixed or reversible manner and is used to disposal food leftovers. The components of the disposal system can be arranged in spatial proximity to one another, e.g. within the same room, but can also be arranged remote from one another, e.g. at different locations and/or in different rooms.

The disposal system comprises at least one disposal apparatus according to the present invention, e.g. according to one or more of the embodiments described above or described in greater detail below. Thus, the disposal system can comprise one disposal apparatus, two disposal apparatuses or more than two disposal apparatuses.

The disposal system furthermore comprises at least one collecting receptacle for receiving comminuted food leftovers, said receptacle being connected or connectable to the disposal apparatus. The collecting receptacle can also be referred to as a waste receptacle. In the context of the present invention, a "collecting receptacle" should fundamentally be understood to be any receptacle which is connected or can be connected to the at least one disposal apparatus, e.g. via at least one temporarily installed or permanently installed pipe, and which is suitable for receiving food leftovers comminuted in the disposal apparatus. For example, the collecting receptacle can be in the form of a drum and/or of a container. By way of example, the collecting receptacle can have at least one receiving chamber for receiving food leftovers which is fully or partially surrounded by at least one receptacle wall. The receptacle wall can be produced fully or partially from at least one metallic material and/or from at least one plastics material, for example. The collecting receptacle can furthermore have at least one door and/or at least one closure, e.g. at least one cover and/or at least one sliding door. In particular, the collecting receptacle can furthermore comprise at least one connection and/or at least one connection piece for a pipe via which comminuted food leftovers can be transferred, e.g. pumped, from the at least one disposal apparatus, in particular the at least one collecting chamber of the at least one disposal apparatus, into the receiving chamber.

The collecting receptacle can be installed at a fixed location, e.g. at a central collecting point, e.g. in a courtyard or cellar, or can also be of mobile or transportable configuration. In the latter case, the collecting receptacle can, for example, be placed temporarily in the vicinity of the disposal apparatus, connected temporarily to the disposal apparatus, e.g. via at least one pipe, in which case comminuted food leftovers are then transferred from the disposal apparatus, e.g. from the collecting chamber of the disposal apparatus, into the collecting receptacle, e.g. by means of a pumping operation. Thus, for example, as explained above, the disposal apparatus can comprise at least one pump for pumping comminuted food leftovers out of the collecting chamber of the disposal apparatus. This pump can be designed to pump the comminuted food leftovers out of the collecting chamber of the disposal apparatus into the collecting receptacle. As an alternative or in addition, however, at least one pump which is not a component part of the disposal apparatus but is, in whole or in part for example, a component part of the collecting receptacle and/or is configured in whole or in part as a separate pump can also be included in the disposal system. Emptying the collecting chamber of the disposal apparatus by means of a vacuum device, which can be associated with the collecting receptacle for example, is likewise possible as an alternative or in addition. Accordingly, the disposal system can have at least one vacuum device for example, i.e. a device which is designed to produce a vacuum and, by means of this vacuum, to feed comminuted food leftovers out of the collecting chamber of the disposal apparatus to the collecting receptacle. For example, the vacuum device can be a component part of the collecting receptacle or can be connected to the collecting receptacle. In general, the collecting receptacle can be connected or connectable to the at least one collecting chamber of the at least one disposal apparatus via at least one pipe, for example. This pipe can be installed in a fixed or reversible manner or can also be mounted in a purely temporary way.

The disposal system can be configured in various ways and can fundamentally be adapted in a flexible manner to the respective requirements and circumstances. Thus, it is possible to provide just a single disposal apparatus, which can be installed in a fixed location in the region of a kitchen and/or in a work area, for example. The collecting chamber can be emptied into the collecting receptacle at regular or irregular intervals, e.g. on the basis of filling level information supplied by the at least one level sensor in the collecting chamber of the disposal apparatus, this being initiated automatically or by a user. As explained above, it is possible for this purpose for the collecting receptacle to be mounted in a fixed location and to be connected to the collecting chamber, e.g. via at least one pipe, or the collecting receptacle can be connected temporarily to the collecting chamber, e.g. by moving the collecting receptacle temporarily into the vicinity of the disposal apparatus.

As an alternative, the disposal system can also be configured as a relatively large disposal system, having a plurality of disposal apparatuses, which are connected permanently or temporarily to one or more collecting receptacles, e.g. via a pipe system comprising one or more pipes. In this way, it is possible, for example, to supply even relatively large kitchens in an appropriate manner by using the disposal systems as deposition stations for food leftovers, with comminution being implemented and followed by transfer into the at least one collecting receptacle.

As an option, the disposal system can have a system controller, which can be of centralized or decentralized configuration. The at least one optional controller of the abovementioned at least one disposal apparatus can be a component part of this system controller, for example, or can also be designed to communicate with the system controller, e.g. in order to exchange information and/or commands unidirectionally or bidirectionally. As regards possible embodiments of the system controller, it is in principle possible to refer to the possibilities for the optional controller of the disposal apparatus.

The disposal apparatus can furthermore have at least one pump for pumping comminuted food leftovers out of the collecting chamber. For example, at least one opening can be provided in the collecting chamber and/or at least one connection piece can be provided in the collecting chamber, said connection piece being connected to a pump or being connectable to a pump. At least one pump for pumping the comminuted food leftovers out of the collecting chamber can be a component part of the disposal apparatus, for example.

In another aspect of the present invention, a method for disposing of food leftovers is proposed. The method comprises the steps described in detail below, which can be carried out in the stated sequence, for example. In principle, however, some other sequence is possible. One or more of the method steps mentioned can also be carried out with a time overlap, simultaneously or repeatedly.

The method comprises loading at least one comminuter with the food leftovers. The comminuter has at least one grinding chamber and at least one collecting chamber, wherein the grinding chamber is connected to the collecting chamber via one or more openings, e.g. via one or more screens. Loading of the grinding chamber with the food leftovers comprises feeding the food leftovers to the grinding chamber. The method furthermore comprises comminuting the food leftovers in the grinding chamber by means of at least one impact tool. The method furthermore comprises at least one process of generating a movement in the food leftovers by means of at least one mixing device in the grinding chamber. Particularly by means of the movement in the food leftovers generated by the mixing device in the grinding chamber, it is possible to discharge comminuted food leftovers continuously or discontinuously from the grinding chamber into the collecting chamber.

As regards possible embodiments and/or definitions of the terms used in the context of the description of the method, reference can be made to the above description of the disposal apparatus and to the following illustrative embodiments. In particular, the method can be carried out using the disposal apparatus according to the present invention, e.g. in accordance with one or more of the illustrative embodiments described above and/or using one or more of the illustrative embodiments described in detail below. In particular, the method can furthermore be carried out using the disposal system according to the present invention, e.g. in accordance with one or more of the illustrative embodiments described above and/or using one or more of the illustrative embodiments described in detail below. As regards possible embodiments of the method, reference can accordingly be made to the description of the disposal apparatus and/or of the disposal system. In principle, however, other embodiments are also conceivable.

The proposed disposal apparatus and the proposed method for disposing of food leftovers has numerous advantages over known disposal apparatuses and methods. Thus, in particular, one important advantage that may be mentioned is that the overall volume of the disposal apparatus and/or of a system including the disposal apparatus can be kept very small. Accordingly, as explained above, the disposal apparatus can also be used in relatively small kitchens or in other relatively small facilities for communal catering. In particular, the disposal apparatus can also be configured as an under-table model. A passage into a separate room, e.g. into a cellar room situated underneath the actual kitchen or facility, is fundamentally not required.

In principle, the disposal apparatus can furthermore be configured as a closed system. As a result, it can be configured in a manner which is nonhazardous in terms of hygiene and involves little odor. Food leftovers can be converted directly at the location where they arise into a pumpable comminuted mass, which can then be used without further treatment in a biogas plant, for example.

Moreover, only a little or, in principle, no water or other cleaning agent is required for the operation of the disposal apparatus. Thus, it is, in principle, no longer necessary to remove such liquids from the waste. Moreover, there is no need for a freshwater connection or a wastewater connection. Thus, overall, it is possible to make a significant reduction in the structural requirements for the operation of the disposal apparatus and also in the operating costs.

The disposal apparatus according to the invention can furthermore be operated continuously or, if there is a relatively small quantity of food leftovers produced, it can also alternatively operate merely in a discontinuous way.

In the disposal apparatus, e.g. in a deposition station of the disposal apparatus, only a few components are required in principle. As a result, as explained above, the disposal apparatus can be configured in a compact, robust and functionally reliable way overall. Moreover, a low-cost construction is possible by virtue of the small number of components.

All the required component parts of the disposal apparatus can furthermore be integrated in a space-saving manner into the disposal apparatus, which can be embodied in whole or in part as a deposition station. It is possible for just a single collecting receptacle, which can receive one or more days' waste for example, to be provided at a central point, for example. This receiving receptacle can be connected to the collecting chamber via a pipe system, for example, wherein the pump described above can be used to pump comminuted food leftovers out of the collecting chamber into the collecting receptacle or waste receptacle, for example.

Since a single disposal apparatus in the form of a single deposition station need fundamentally take up only a little space, it is also possible, for example, for a plurality of such devices to be used in a kitchen. A control link between the individual disposal apparatuses is fundamentally unnecessary. However, it is also optionally possible for a plurality of the disposal apparatuses described to be interconnected to form a disposal system.

By processing the food leftovers into a comminuted and preferably pumpable mass, also referred to as a substrate, it is furthermore possible to use small conduit cross sections. Thus, the pump described above and/or the pipes via which the comminuted food leftovers can be pumped out of the collecting chamber into a collecting receptacle or waste receptacle can be of very small dimensions. For example, conduit cross sections with a diameter of no more than or even less than 75 mm can be used, preferably having a diameter of no more than 50 mm. Thus, for example, the collecting chamber can be connected to a connection piece which has a conduit cross section of no more than 50 mm, e.g. a nominal diameter of 50 mm. As regards installation, these small conduits can be laid virtually anywhere without problems.

Overall, a small and low-cost disposal system can be achieved with the present invention. The disposal apparatus is also suitable for relatively small kitchens for communal catering. It is fundamentally capable of being installed in a built-under position and can be installed flexibly in a work area, e.g. in a scullery and/or in a preparation zone. The food leftovers can be comminuted directly at the point where they arise and can then be transferred into a collecting tank via a hose or a pipe, for example. Thus, the collecting chamber can be connected via one or more pipes to a larger collecting receptacle, collecting tank or waste receptacle. The pump described above can be provided for the purpose of carrying out this transfer.

The disposal apparatus can comprise the comminuter described above, which can comprise a housing and a grinding mechanism. Food leftovers can be fed to the comminuter through a chute. By means of a pump, the comminuted material can be pumped out of the comminuter, e.g. the collecting chamber. As explained above, a controller can furthermore be provided.

The actual grinding chamber, in which a grinding mechanism can rotate for example, can be provided in the housing of the comminuter. The housing of the comminuter can be formed by a surrounding wall, for example, also referred to above as a grinding chamber wall. Thus, an additional chamber, which can be used as a collecting chamber in the sense according to the above description, can be formed between the grinding chamber and the actual housing walls of the comminuter. The wall of the grinding chamber can be at least partially penetrated, thus allowing liquids and/or particles below a certain size to pass out of the grinding chamber into the interspace and/or the collecting chamber. The entire grinding mechanism can also be tilted backward, as explained above, and in this way can be built into the comminuter. In this way, by means of the tilt of the grinding chamber, it is possible to ensure that food leftovers are fed to the comminuting device, in particular the grinding mechanism, in particular under their own weight. At the very least, however, the bottom of the grinding chamber can be embodied with a slope relative to the comminuting device, in particular the grinding mechanism. The bottom can likewise have through holes and can be designed as a component part of the grinding chamber walls, for example, or can be designed as a separate bottom. Thus, the bottom can form a screen, for example, and can be configured in such a way, for example, that only sufficiently comminuted material below a certain particle size can enter the collecting chamber underneath the bottom.

The comminuting device, in particular the grinding mechanism, can be fitted with at least one, preferably two or even a plurality of, flexible impact elements, e.g. chains. These impact tools can be secured on a hub, for example. In particular, the impact elements can be arranged in such a way that no unbalance occurs, ensuring that the disposal apparatus can operate very quietly and with little vibration overall. The impact elements can preferably be manufactured from a very durable material, e.g. a hardened steel. However, other embodiments of the impact elements are also possible in principle.

As explained above, at least one separating device can furthermore be provided in the grinding chamber. In particular, this can be configured in a simple manner in such a way that a separating disk is inserted directly behind the comminuting device. This separating disk can be designed in a simple manner in such a way that it forms a gap with respect to the grinding chamber wall, through which only sufficiently comminuted material can flow off rearward into the fines chamber. However, as an alternative or in addition, the separating disk can also be provided with one or more through holes and accordingly can be designed in whole or in part as a screening disk, for example. This screening disk can likewise be connected to the drive axle, e.g. the hub, and can rotate with the comminuting device, for example. As an alternative or in addition, the at least one separating device, e.g. the at least one screening disk, can also be installed in the grinding chamber in such a way that it remains stationary. Once again as an alternative or in addition, the at least one separating device, e.g. the at least one screening disk, can also be installed in such a way that it is freely rotatable and, for example, has a dedicated drive. This enables the separating device, e.g. the screening disk, to rotate with any desired speed with or counter to the direction of rotation of the comminuting device, for example.

The mixing device can be arranged behind the separating device, e.g. behind the separating disk, e.g. in a fines chamber. With the aid of the mixing device, a flow can be generated, e.g. when the grinding mechanism is rotated, said flow passing through the screening disk and/or the separating device, for example, and/or through the outer gap behind the separating disk, for example, in the case of a simple separating disk. Thus, in general, the mixing device in this illustrative embodiment or in other illustrative embodiments can be designed to generate a movement of the food leftovers from the loading chamber, through the separating device, into the fines chamber. The outflow of comminuted material behind the separating device allows uncomminuted material to be conveyed toward the comminuting device, e.g. toward the impact mechanism. This can improve the efficiency of the comminuter. Thus, in particular, the mixing device can be configured as a fluid flow device. This fluid flow device can be created, for example, by means of a plurality of blades on a rear side of the separating device, e.g. the separating disk. However, as an alternative or in addition, the fluid flow device can in general also take the form of a propeller or other embodiments and does not directly have to be part of the separating disk or connected to the separating disk.

As explained above, the chamber which forms behind the separating disk can also be referred to as a fines chamber. The fines chamber can, in turn, be connected to the collecting chamber via one or more openings, e.g. via one or more through holes. This collecting chamber can be provided at the side of and/or below the grinding chamber, for example. Thus, by means of the one or more openings, sufficiently comminuted material can collect in this collecting chamber.

In particular, as explained, the above-described elements of the impact tool and of the mixing device and, optionally, of the separating device can be arranged on a common drive axle, e.g. a common shaft. As a result, the design can be configured in a very simple and low-cost way.

The grinding mechanism, in particular the impact tool, or at least the mixing device, which can be configured as a fluid flow device, can be driven in the same direction of rotation or, alternatively, in a reverse direction of rotation. The latter, in particular, can enable any blockages that occur in the separating device, e.g. the screening disk and/or separating disk, to be removed. In particular, the comminuting device, e.g. the grinding mechanism, can be formed by at least one electric motor. In particular, at least one electric motor having at least one reduction gear in the form of at least one belt drive, e.g. at least one V-belt drive, can be used. Thus, in particular, the comminuting device can have at least one drive or at least one transmission, e.g. having at least one belt drive, in particular for driving the grinding mechanism. Overall, this enables the disposal apparatus and the method for disposing of the food leftovers to be configured in a very low-noise way. In this way, particularly when using a belt, such as a V-belt, it is furthermore possible to ensure an overload safeguard. Other embodiments for the transmission are likewise conceivable in principle, e.g. a flat belt transmission, a poly-V-belt transmission, a toothed belt transmission, a push-link transmission, a gear mechanism. Combinations of the stated drives or transmissions are also conceivable in principle. The rated speed of the comminuting device, e.g. the grinding mechanism, can be around 1000 rpm, for example. As explained above, however, other speeds can also be used.

At least one level sensor and/or some other type of level detection device can furthermore be arranged in the collecting chamber, that is to say, for example, in the housing of the comminuter outside the grinding chamber and/or in an interspace between a grinding chamber wall and a housing of the comminuter. By means of the at least one level sensor, a filling level in the collecting chamber can be detected, for example. In particular, as explained above, it is a simple matter to use at least one float switch.

As explained above, at least one pump can be connected to the collecting chamber, allowing comminuted and/or pasty food leftovers to be pumped out of the disposal apparatus, which can also be designed as a deposition station. In principle, the pump can be configured in any desired way. In particular, the pump can have at least one impeller pump. However, other types of pump can also be used in principle, e.g. peristaltic pumps or eccentric screw pumps.

The comminuter can be swing-mounted within a housing of the disposal apparatus, i.e. within an external housing, for example. This results, in particular, in noise reduction and/or a reduction in vibration in the working environment. This also enables the disposal apparatus to be integrated easily and conveniently and without troublesome noise into a working environment.

The overall construction of the disposal apparatus, in particular of the deposition station, can furthermore be configured in such a way that all the components are easily accessible, particularly for maintenance. Thus, for example, the comminuter can have a housing which has the abovementioned at least one door, thus allowing unhindered access to the interior, for example. The abovementioned optional pump can also be configured and installed in such a way that maintenance work can be carried out easily if required. For example, the pump can be accessible in a simple manner by removing front panels or rear panels or side panels of an external housing of the disposal apparatus.

As was furthermore explained above, there can be at least one opening at the bottom of the collecting chamber, through which the collecting chamber can also be emptied manually, for example.

In order to improve the overall hygiene situation during pauses in operation and in order to avoid the occurrence of odors, the feed opening can be flushed with water and/or a disinfectant, for example. Moreover, the feed opening can also be of closable configuration. Thus, the disposal apparatus can have at least one closure device for closing the feed opening. For example, the closure device can have at least one plug that can be locked in a fixed or reversible manner. In principle, however, other closure devices, e.g. flaps, slides or other types of closure device, can also be used as an alternative or in addition.

In particular, as explained above, the disposal apparatus, which can be designed as a deposition station, can be a component part of a disposal system which comprises the at least one disposal apparatus. As likewise described above, the disposal system can furthermore comprise at least one collecting receptacle, which is connected in a fixed manner or reversibly to the at least one collecting chamber. For example, the disposal system can comprise at least one pipe system connecting the collecting receptacle to the at least one collecting chamber. The at least one pump described above can furthermore be provided in order to pump comminuted food leftovers out of the collecting chamber, from the collecting chamber into the collecting receptacle, at regular intervals or at irregular intervals or when required. Thus, for example, the disposal apparatus can be arranged as a deposition station at the location where the food leftovers arise, whereas the collecting receptacle can be arranged at some other location in the building, for example, e.g. in a cellar room or a courtyard.

In particular, the disposal apparatus proposed also has considerable advantages over the abovementioned prior art. Thus, inter alia, DE 295 14 167 U1 does not describe the feature of division into a grinding chamber and a collecting chamber, wherein a mixing device designed to generate a movement in the food leftovers in the grinding chamber is arranged in said grinding chamber. By means of this difference, it is possible, in particular, to considerably reduce the overall volume of the disposal apparatus. Moreover, the efficiency of comminution can be significantly increased and, at the same time, water usage can be reduced. In DE 295 14 167 U1, rigid deflectors are provided instead, acting as baffle plates and therefore always additionally requiring already existing movement of the food leftovers deflected by the deflectors. Accordingly, the design described in DE 295 14 167 U1 always also requires an additional supply of considerable quantities of water, which can be avoided in the context of the disposal apparatus proposed.

As compared with JP 2008-114 149 A, US 2010/0 276 526 A1 and DE 43 00 784 A1 too, the apparatus proposed has considerable advantages since these documents do not disclose the stated features of the proposed disposal apparatus either. Thus, in JP 2008-114 149 A, a considerable additional installation space has to be provided for the "moving vane", wherein this element is also not arranged in the grinding chamber and, accordingly, cannot bring about movement there. Also in JP 2008-114 149 A, a water supply for transporting and/or comminuting the food leftovers is accordingly provided. However, this supply of water has the disadvantage that the water supplied has to be removed from the waste again in an expensive manner at the end of the process—in contrast to the proposed solution, which can basically avoid the need to use water as a transfer medium, even if this is possible in principle.

Although water supply is not necessarily provided in US 2010/0 276 526 A1, this is at the expense of a complex conveying system in the form of feed screws. These, in turn, require a considerable additional installation space. Moreover, the conveying system is not arranged in the grinding chamber itself, and no movement is brought about in the grinding chamber itself, with the result that the food leftovers are not kept in movement in the grinding chamber itself. Accordingly, the comminution efficiency of the apparatus described in US 2010/0 276 526 A1 is inferior to the comminution efficiency of the apparatus proposed in the present case.

In summary, the following embodiments are particularly preferred in the context of the present invention:

Embodiment 1 disposal apparatus for disposing of food leftovers, comprising at least one comminuter, wherein the comminuter has at least one grinding chamber and at least one collecting chamber, wherein the grinding chamber is connected to the collecting chamber via one or more openings, wherein at least one comminuting device having at least one impact tool for comminuting the food leftovers is arranged in the grinding chamber, wherein, in addition, at least one mixing device for generating a movement in the food leftovers is arranged in the grinding chamber.

Embodiment 2 disposal apparatus according to the preceding embodiment, wherein the comminuting device comprises a grinding mechanism.

Embodiment 3 disposal apparatus according to one of the preceding embodiments, wherein the impact tool is formed separately from the mixing device.

Embodiment 4 disposal apparatus according to one of the preceding embodiments, wherein the impact tool has at least a plurality of impact members connected to one another in an articulated manner.

Embodiment 5 disposal apparatus according to one of the preceding embodiments, wherein the impact tool has at least one chain.

Embodiment 6 disposal apparatus according to one of the preceding embodiments, wherein the impact tool has chains that are each connected at one end to at least one drive axle.

Embodiment 7 disposal apparatus according to one of the preceding embodiments, wherein the impact tool has two chains arranged at mutually opposite ends and connected to a drive axle.

Embodiment 8 disposal apparatus according to one of the preceding embodiments, wherein the impact tool rotates around a drive axle.

Embodiment 9 disposal apparatus according to one of the preceding embodiments, wherein the comminuting device has at least one drive axle and at least one drive, wherein the drive is designed to impart a rotation to the drive axle, in particular a rotation of 500-2000 rpm and particularly preferably a rotation of 1000 rpm.

Embodiment 10 disposal apparatus according to the preceding embodiment, wherein the drive has a belt drive, in particular a V-belt drive.

Embodiment 11 disposal apparatus according to the preceding embodiment, wherein the drive comprises a drive disk arranged outside the grinding chamber, in particular a belt pulley, which is connected to the drive axle.

Embodiment 12 disposal apparatus according to one of the three preceding embodiments, wherein the drive furthermore comprises at least one drive motor arranged outside the grinding chamber, said drive motor being connected to the drive axle.

Embodiment 13 disposal apparatus according to one of the four preceding embodiments, wherein the drive axle passes through a grinding chamber wall of the grinding chamber.

Embodiment 14 disposal apparatus according to one of the preceding embodiments, wherein the comminuting device and the mixing device are driven by a common drive.

Embodiment 15 disposal apparatus according to one of the preceding embodiments, wherein the impact tool and the mixing device are arranged axially spaced apart on a drive axle.

Embodiment 16 disposal apparatus according to one of the preceding embodiments, wherein the mixing device is designed to generate a flow in the food leftovers.

Embodiment 17 disposal apparatus according to one of the preceding embodiments, wherein the mixing device has at least one blade, preferably at least two or at least three blades.

Embodiment 18 disposal apparatus according to the preceding embodiment, wherein the blades can be mounted so as to be rotatable about a drive axle.

Embodiment 19 disposal apparatus according to one of the preceding embodiments, wherein the mixing device is designed to generate the movement in the food leftovers in a region of the openings, ensuring that comminuted food leftovers are guided to the openings by the movement.

Embodiment 20 disposal apparatus according to one of the preceding embodiments, wherein the grinding chamber is divided into at least one loading chamber for receiving uncomminuted food leftovers and at least one fines chamber for receiving fully or partially comminuted food leftovers.

Embodiment 21 disposal apparatus according to the preceding embodiment, wherein the comminuting device is arranged fully or partially in the loading chamber or between the loading chamber and the fines chamber.

Embodiment 22 disposal apparatus according to one of the two preceding embodiments, wherein the mixing device is arranged fully or partially in the fines chamber.

Embodiment 23 disposal apparatus according to one of the three preceding embodiments, wherein the comminuter has at least one separating device for separating the loading chamber and the fines chamber, wherein only food leftovers of a predetermined maximum size can pass through the separating device.

Embodiment 24 disposal apparatus according to the preceding embodiment, wherein the separating device is chosen from a separating disk or a screen.

Embodiment 25 disposal apparatus according to one of the two preceding embodiments, wherein the impact tool, the mixing device and the separating device are mounted on a common drive axle.

Embodiment 26 disposal apparatus according to one of the six preceding embodiments, wherein the loading chamber can be loaded with uncomminuted food leftovers via at least one loading opening.

Embodiment 27 disposal apparatus according to one of the seven preceding embodiments, wherein the fines chamber is arranged in such a way relative to the loading chamber that comminuted food leftovers are moved from the loading chamber into the fines chamber under the action of gravity.

Embodiment 28 disposal apparatus according to one of the eight preceding embodiments, wherein the fines chamber is arranged at least partially below the loading chamber.

Embodiment 29 disposal apparatus according to one of the nine preceding embodiments, wherein the grinding chamber has an axis, in particular a cylinder axis, which slopes by an angle relative to a horizontal.

Embodiment 30 disposal apparatus according to the preceding embodiment, wherein the slope is 5° to 70°, in particular 10° to 45°.

Embodiment 31 disposal apparatus according to one of the two preceding embodiments, wherein the grinding chamber has a circular, polygonal or oval cross section.

Embodiment 32 disposal apparatus according to one of the three preceding embodiments, wherein the grinding chamber has a cylinder shape or drum shape.

Embodiment 33 disposal apparatus according to one of the preceding embodiments, wherein a bottom of the grinding chamber slopes by an angle relative to a horizontal, in particular by an angle of 5° to 70°, preferably by an angle of 10° to 45°.

Embodiment 34 disposal apparatus according to one of the preceding embodiments, wherein the grinding chamber has at least one grinding chamber wall, wherein the one or more openings are arranged in the grinding chamber wall and allow comminuted food leftovers to cross from the grinding chamber to the collecting chamber.

Embodiment 35 disposal apparatus according to one of the preceding embodiments, wherein the one or more openings form at least one screen.

Embodiment 36 disposal apparatus according to one of the preceding embodiments, wherein the one or more openings have a diameter or equivalent diameter of 3 mm to 15 mm.

Embodiment 37 disposal apparatus according to one of the preceding embodiments, wherein the grinding chamber has at least one door for carrying out maintenance work, in particular a door having at least one seal.

Embodiment 38 disposal apparatus according to one of the preceding embodiments, wherein the collecting chamber has at least one door for carrying out maintenance work, in particular a door having at least one seal.

Embodiment 39 disposal apparatus according to the two preceding embodiments, wherein the door of the grinding chamber and the door of the collecting chamber are designed as a common door.

Embodiment 40 disposal apparatus according to one of the preceding embodiments, wherein the collecting chamber has at least one opening for manual emptying.

Embodiment 41 disposal apparatus according to one of the preceding embodiments, wherein the disposal apparatus furthermore has at least one pump for pumping comminuted food leftovers out of the collecting chamber.

Embodiment 42 disposal apparatus according to one of the preceding embodiments, wherein the disposal apparatus furthermore has at least one level sensor for detecting at least one level of comminuted food leftovers in the collecting chamber.

Embodiment 43 disposal apparatus according to the preceding embodiment, wherein the level sensor has at least one float switch.

Embodiment 44 disposal apparatus according to one of the preceding embodiments, wherein the disposal apparatus has at least one controller, wherein the controller is designed to fully or partially control the disposal apparatus.

Embodiment 45 disposal apparatus according to the preceding embodiment, wherein the controller is furthermore designed to monitor a filling level in the collecting chamber.

Embodiment 46 disposal apparatus according to one of the preceding embodiments, wherein a bottom of the collecting chamber slopes toward a collecting point or collecting region.

Embodiment 47 disposal apparatus according to one of the preceding embodiments, wherein the collecting chamber at least partially surrounds the grinding chamber.

Embodiment 48 disposal apparatus according to one of the preceding embodiments, wherein the comminuter is arranged within a housing of the disposal apparatus.

Embodiment 49 disposal apparatus according to the preceding embodiment, wherein the housing has at least one feed opening for feeding in food leftovers, wherein the feed opening is connected to the grinding chamber.

Embodiment 50 disposal apparatus according to the preceding embodiment, wherein the feed opening comprises a feed hopper.

Embodiment 51 disposal apparatus according to one of the two preceding embodiments, wherein the feed opening is connected to the grinding chamber by at least one chute.

Embodiment 52 disposal apparatus according to one of the three preceding embodiments, wherein the feed opening is arranged in a work surface of the housing, in particular in an upper work surface and particularly preferably in a flat work surface.

Embodiment 53 disposal apparatus according to one of the five preceding embodiments, wherein the housing has a pedestal.

Embodiment 54 disposal apparatus according to one of the six preceding embodiments, wherein the housing has a height of no more than 1.5 m, preferably no more than 1.0 m.

Embodiment 55 disposal apparatus according to one of the seven preceding embodiments, wherein the housing has at least one door, wherein the comminuter can be accessed by opening the door, in particular at least one door with a vertical hinge and/or at least one removable panel.

Embodiment 56 disposal system for disposing of food leftovers, comprising at least one disposal apparatus according to one of the preceding embodiments, furthermore comprising at least one collecting receptacle for receiving comminuted food leftovers, said receptacle being connected or connectable to the disposal apparatus.

Embodiment 57 disposal system according to the preceding embodiment, wherein the collecting receptacle is connected or connectable to the collecting chamber of the disposal apparatus via at least one pipe.

Embodiment 58 a method for disposing of food leftovers, comprising loading of at least one comminuter with the food leftovers, wherein the comminuter has at least one grinding chamber and at least one collecting chamber, wherein the grinding chamber is connected to the collecting chamber via one or more openings, loading comprises feeding the food leftovers to the grinding chamber, wherein the method furthermore comprises comminuting the food leftovers in the grinding chamber by means of at least one impact tool, wherein the method furthermore comprises at least one process of generating a movement in the food leftovers by means of at least one mixing device in the grinding chamber.

Embodiment 59 a method according to the preceding embodiment, wherein the method comprises a use of a disposal apparatus according to one of the preceding embodiments relating to a disposal apparatus.

Embodiment 60 a method according to one of the two preceding embodiments, wherein comminuted food leftovers are discharged continuously or discontinuously from the grinding chamber into the collecting chamber by the movement in the food leftovers.

BRIEF DESCRIPTION OF THE FIGURES

Further details and features of the invention will become apparent from the following description of preferred illustrative embodiments, in particular in conjunction with the dependent claims. Here, the respective features can be implemented in isolation or together in combination with one another. The invention is not restricted to the illustrative embodiments. The illustrative embodiments are shown schematically in the figures. Here, identical reference signs in the individual figures denote elements which are identical or functionally identical or correspond to one another in terms of their functions.

In particular.

DESCRIPTION OF THE ILLUSTRATIVE EMBODIMENTS

Figure 1:
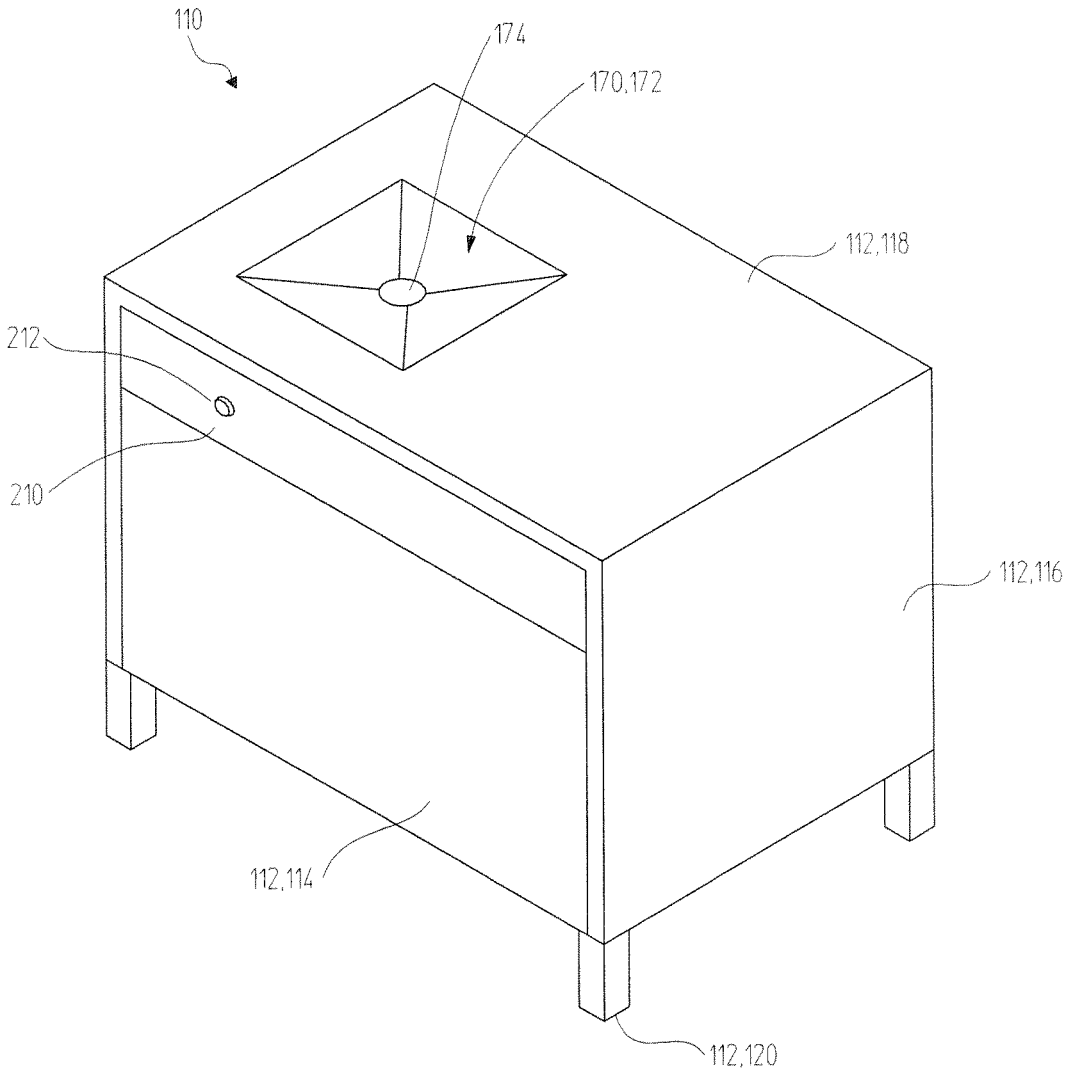
FIG. 1 shows a perspective overall view of one illustrative embodiment of a disposal apparatus according to the invention.
Figure 2:
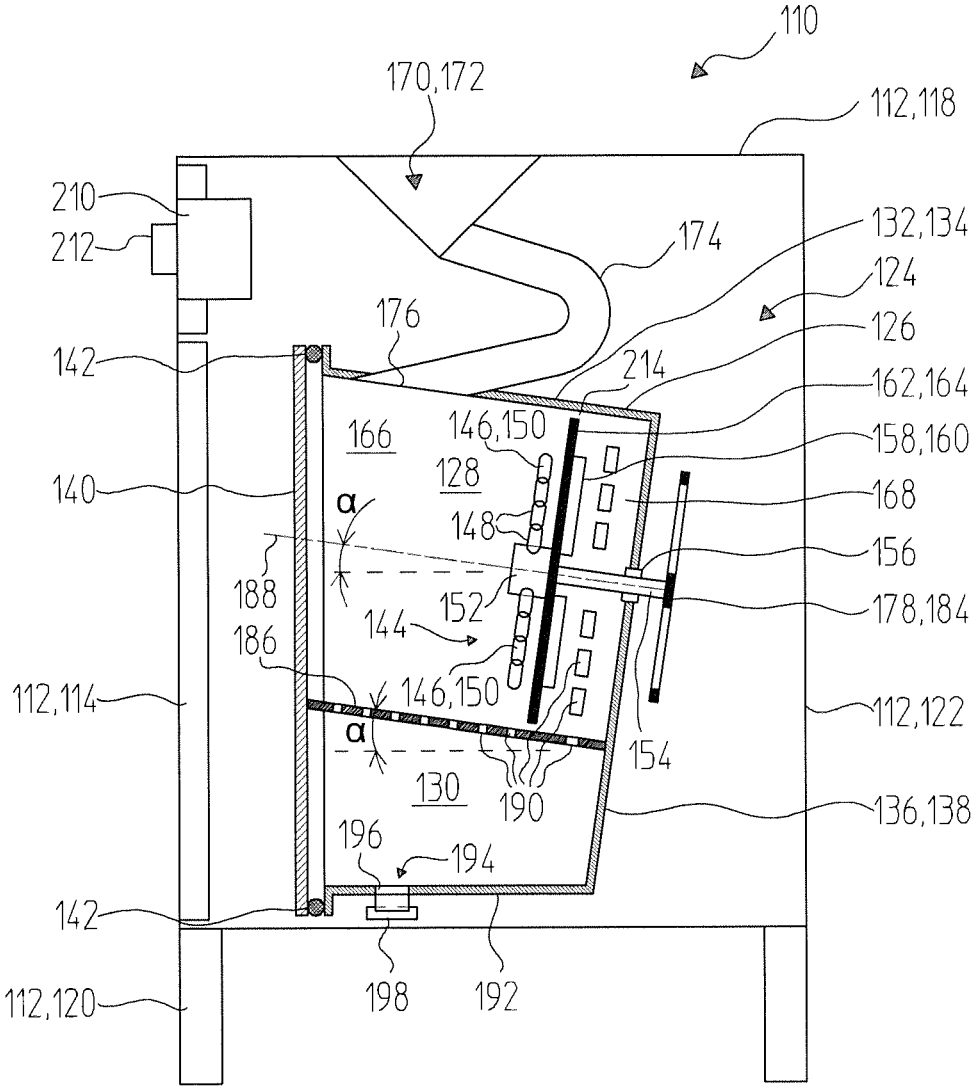
FIG. 2 shows a section through the disposal apparatus according to FIG. 1 in a cross section.
Figure 3:
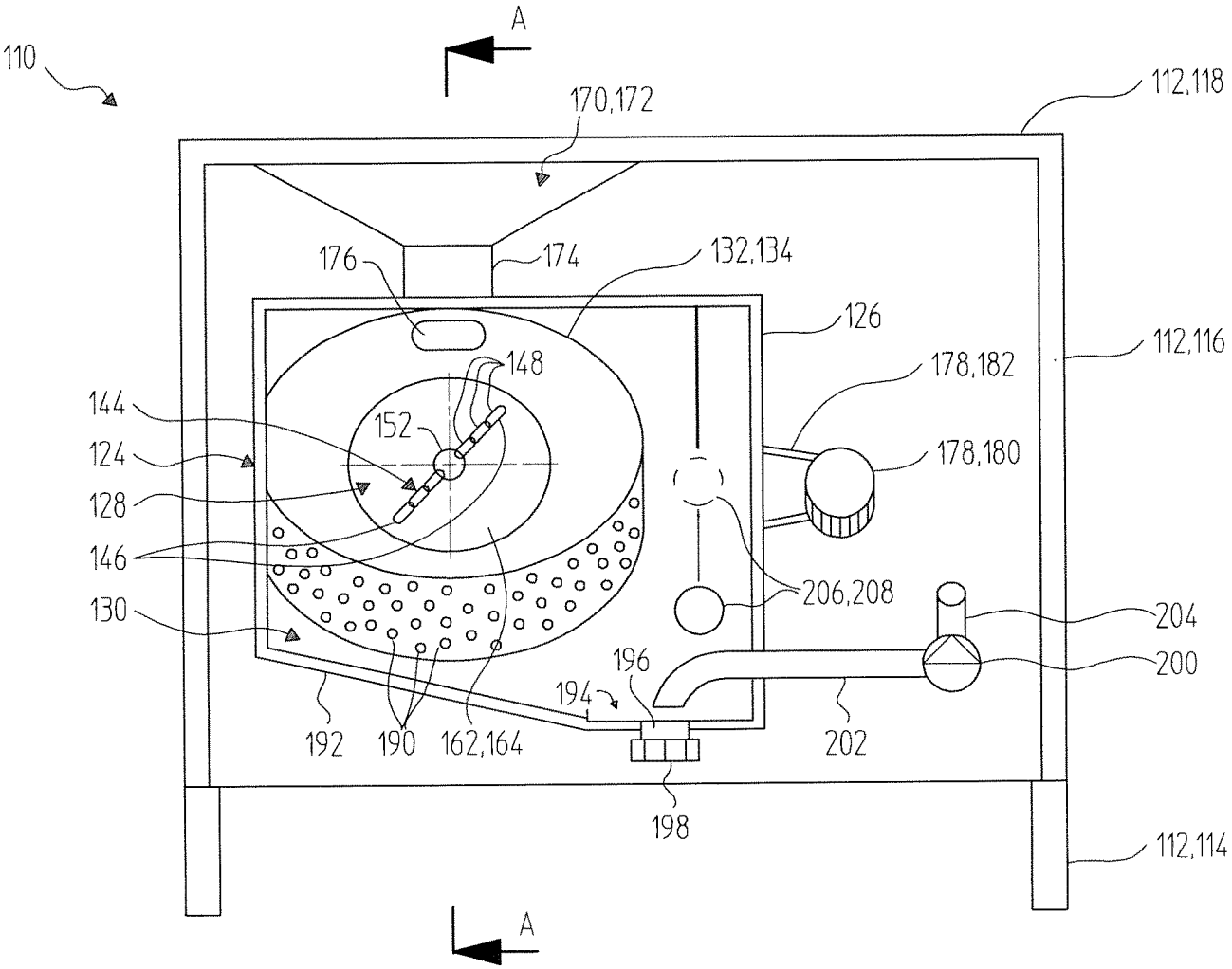
FIG. 3 shows a front view of the disposal apparatus with the front panel removed.
Figure 4:
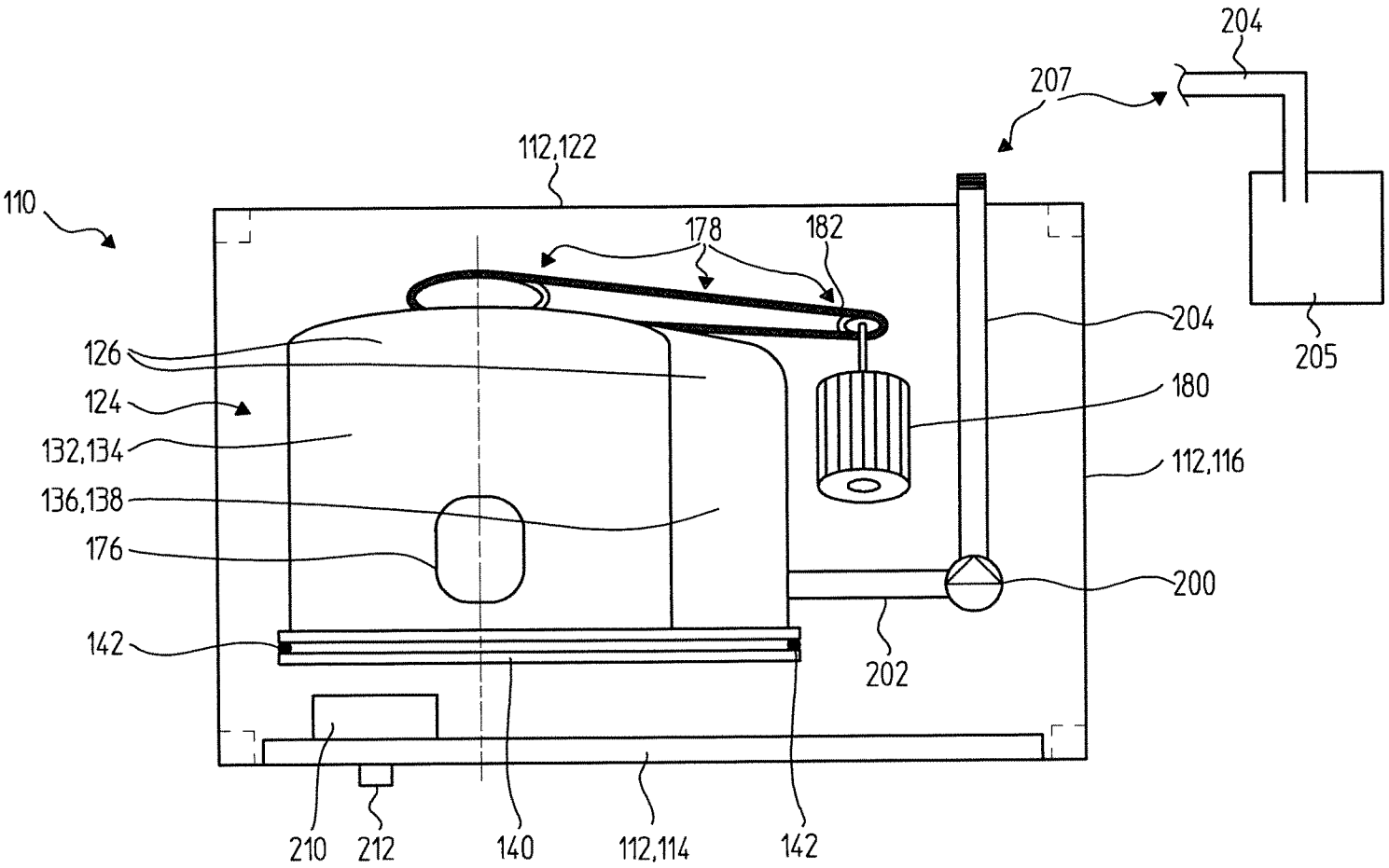
FIG. 4 shows a plan view of the disposal apparatus according to FIG. 1 with the top cover removed and a schematic illustrative embodiment of a disposal system.

In FIGS. 1 to 4, one possible illustrative embodiment of a disposal apparatus 110 according to the invention for disposing of food leftovers is shown in various views and representations. The disposal apparatus 110 can also be referred to as a deposition station or can be configured and/or used as a deposition station. Here, FIG. 1 shows a perspective representation of the disposal apparatus 110, FIG. 2 shows a section through the disposal apparatus 110 in cross section, along a section line A-A in FIG. 3, FIG. 3 shows a front view of the disposal apparatus 110 with the front panel removed, and FIG. 4 shows a plan view of the disposal apparatus 110 with the top cover removed. In the description which follows, joint reference is made to these figures. As indicated schematically in FIG. 4, the disposal apparatus 110 can furthermore be a component part of a disposal system described in detail below.

The disposal apparatus 110 in the illustrative embodiment shown in the figures first of all preferably comprises an external housing 112, which is preferably of multi-part configuration. As can be seen in FIG. 1, for example, the external housing comprises a front panel 114, side panels 116, a top cover 118 (also referred to as a work surface) and, optionally, a stand 120, for example. As can be seen in FIG. 2, the external housing 112 can furthermore have a rear panel 122. The panels 114, 116 and 122 and the top cover 118 can each be installed in a fixed manner but can each also be configured so as to be individually removable. In particular, the front panel 114 can be of removable configuration, thus allowing access to the components in the interior of the external housing 114 by removal of the front panel.

A comminuter 124 is accommodated in the interior of the housing. By way of example, this comminuter 124 can be supported in the interior of the housing 112 by means of an appropriate suspension (not shown in the figures), which brings about vibration damping for example. The comminuter 124 comprises a comminuter housing 126 and is divided into a grinding chamber 128 and a collecting chamber 130. Here, the grinding chamber 128 is fully or partially surrounded by the collecting chamber 130, as can be seen in FIG. 3 for example. The grinding chamber 128 is formed by at least one grinding chamber wall 132, which forms a grinding chamber housing 134 as part of the comminuter housing 126. The collecting chamber 130 is formed substantially by at least one collecting chamber wall 136, which forms a collecting chamber housing 138. The grinding chamber 128 and the collecting chamber 130 can be opened toward the front, toward front panel 114, and can be closed by a common door 140, which can be seen particularly in FIGS. 2 and 4. In particular, the door 140 can have a seal 142. The collecting chamber 130 and/or the grinding chamber 128 and devices and/or food leftovers situated therein can be accessed for maintenance by opening the door 140, e.g. by removing said door 140.

Within the grinding chamber 128, the comminuter 124 furthermore has at least one comminuting device 144, which can also be referred to as a grinding mechanism. The comminuting device 144 comprises at least one impact tool 146, in particular an impact tool 146 having a plurality of impact members 148 connected to one another in an articulated manner. In particular, the at least one impact tool 146 can comprise one or more chains 150. Accordingly, the comminuting device 144 can be configured more particularly as a chain grinding mechanism.

In the illustrative embodiment shown, the impact tool 146 is connected by at least one hub 152 to at least one drive axle 154, which can also be referred to as a drive shaft. As can be seen from FIG. 2, this drive axle 154 is passed out of the grinding chamber 128 on a rear side of the grinding chamber housing 134, e.g. via a shaft seal 156 or some other kind of leadthrough.

In addition to the comminuting device 144, there is furthermore at least one mixing device 158 arranged in the grinding chamber 128. This mixing device 158 can have a plurality of blades 160 and/or a propeller, for example. The blades 160 can be connected directly or indirectly to the drive axle 158, for example. In the example shown in FIG. 2, the blades 160 are connected to the drive axle 154 by means of a separating disk 162, for example, said separating disk being a component part of a separating device 164. Thus, for example, the blades 160 can be arranged on a side of the separating disk 162 facing away from the comminuting device 144, with the result that the separating disk 162 is situated between the impact tool 146 and the mixing device 158. As an alternative, the blades 160 could also be connected directly to the drive axle 154 or could be arranged completely separately from the comminuting device 144. In general terms, the mixing device 158 is designed to bring about a movement, e.g. a flow, within the food leftovers accommodated in the grinding chamber 128.

The grinding chamber 128 is divided by the separating device 164 into a loading chamber 166 and a fines chamber 168. The loading chamber 166 can be loaded with food leftovers via a loading opening 170, which is arranged in the top cover 118 and can also be referred to as a feed opening 172, and via a chute 174, which can be of funnel-shaped configuration in whole or in part, for example. The chute 174 can open into an opening 176 at the upper end of the grinding chamber 128, for example.

The comminuting device 144 is driven by at least one drive 178 via the drive axle 154. By way of example, the drive 178 can comprise a drive motor 180 and, for example, a V-belt drive having at least one V-belt 182. By way of example, the V-belt 182 can drive a driving pulley 184, which is connected to the drive axle 154.

As can be seen in FIGS. 2 and 3, for example, the grinding chamber 128 can, in particular, be configured in such a way that food leftovers slide from the loading chamber 166 into the fines chamber 168 under their own weight and/or due to a movement or flow generated by means of the mixing device 158 during or after comminution. For this purpose, a bottom 186 of the grinding chamber 128 can slope in such a way, for example, that the food leftovers can slide from the loading chamber 166 into the fines chamber 168. By way of example, the bottom 168 can have a slope angle $\alpha$ relative to a horizontal, which can be 10° to 45°, e.g. 30°, in this illustrative embodiment, for example. Other configurations are also possible. Similarly, as in the illustrative embodiment shown, the grinding chamber 128 can be of substantially cylindrical configuration, for example, with a cylinder axis 188 which slopes relative to a horizontal, likewise by the angle $\alpha$, for example.

In the illustrative embodiment shown, the grinding chamber 128 is connected to the collecting chamber 130 via a plurality of openings 190 in the grinding chamber wall 132. For example, the grinding chamber wall 132 can be designed completely or partially as a screen. In this way, comminuted food leftovers with a maximum diameter and/or equivalent diameter that can be predetermined by the openings 190 can pass from the grinding chamber 128 into the collecting chamber 130.

At least one opening 196 for manual emptying can be provided in the collecting chamber 130, e.g. in a collecting region 194, the bottom 192 of which chamber can slope toward the collecting region 194. This opening can be closable by means of at least one closure 198, for example, e.g. by means of a screw closure.

The disposal apparatus 110 can furthermore have at least one pump 200 for pumping comminuted food leftovers out of the collecting chamber 130. This pump 200, which can be seen, in particular, in FIGS. 3 and 4, can draw in food leftovers out of the collecting chamber 130, e.g. via at least one extraction connection piece 202, which preferably opens, in turn, into the collecting region 194, and can feed said leftovers to a collecting receptacle 205 or waste receptacle shown in FIG. 4, e.g. via a pipe 204. This collecting receptacle 205 or waste receptacle can be connected to the disposal apparatus 110 temporarily or permanently, for example. For example, this collecting receptacle 205 can form a disposal system 207 together with the at least one disposal apparatus 110, as likewise indicated in FIG. 4.

In the illustrative embodiment shown, the disposal apparatus 110 furthermore has at least one level sensor 206, in particular at least one float switch 208. This level sensor 206 can monitor a filling level within the collecting chamber 130, for example, and transmit corresponding filling level information to a controller 210 of the disposal apparatus 110, for example. This controller 210, which can be provided independently of the level sensor 206, can be arranged in the front panel 214, for example, and/or can comprise at least one operating element 212 accessible from the front panel 114. In particular, the controller 210 can be designed to control the comminuting device 144, e.g. via appropriate control of the drive motor 180. The controller 210 can furthermore be designed, for example, to monitor the filling level in the collecting chamber 130 and/or to control pumping of the food leftovers out of the collecting chamber 130 by means of the pump 200.

During the operation of the disposal apparatus, the drive axle 154 drives the comminuting device 144. In this arrangement, the impact members 148 of the impact tool 146 are preferably arranged in such a way that no unbalance occurs during rotation. The impact members 148, which can also be referred to as impact elements, are preferably manufactured from a very durable material, e.g. hardened steel. By means of the impact tool 146, the food leftovers are comminuted. The separating device 164 allows the comminuted food leftovers to pass through from the loading chamber 166 into the fines chamber 168. For example, they can pass through via an encircling gap 214 between the separating disk 162 and the grinding chamber wall 132, through which sufficiently comminuted material can flow off into the fines chamber 168. As an alternative or in addition, however, the separating disk 162 can also be provided with one or more through holes and can form a screening disk, for example. This screening disk can likewise be connected to the hub 152 and/or the drive axle 154, for example, and can thus rotate along with the grinding mechanism. As an alternative, however, the screening disk can also be arranged in the grinding chamber 128 in such a way that it remains stationary during the operation of the comminuting device 144. Once again as an alternative or in addition, it is also possible for the separating disk 162, e.g. the screening disk, to be installed in such a way that it is freely rotatable, has a dedicated drive and, as a result, can rotate at, for example, any desired speed or, alternatively, counter to the direction of rotation of the comminuting device 144.

The mixing device 158 is provided behind the separating device 164, e.g. the separating disk 162. As the comminuting device 144 rotates, a flow, for example, can be generated with the aid of said mixing device 158, and this flow can cause comminuted material to flow off into the fines chamber 168 through the separating device 164 (e.g. the screening disk and/or the gap 214). By this means, it is possible, for example, to convey uncomminuted material to be ground into the comminuting device, and this can improve the efficiency of the comminuting device 144. As explained above, the mixing device 158, which can also be referred to as a fluid flow device, can be provided by a plurality of blades on the rear side of the separating disk 162, for example. However, it can also have the form of a propeller or, alternatively, some other configuration and, in principle, does not have to be directly part of the separating disk 162 or be connected to the separating disk.

As explained above, the grinding chamber 128 and, in said grinding chamber, the fines chamber 168, in particular, are connected to the collecting chamber 130 via the plurality of openings 190, which can be configured as through holes, for example. The collecting chamber 130 can be situated to the side and/or below the grinding chamber 128, for example, and can be designed as an interspace between the grinding chamber 128 and the external housing 112, for example. The collecting chamber 130 can furthermore fully or partially surround the grinding chamber. Comminuted material can accumulate in the collecting chamber 130.

As explained above, the elements of the comminuting device 144 and of the mixing device 158 are preferably arranged on at least one common drive axle 154, e.g. a shaft. It is thereby possible to significantly simplify the construction of the disposal apparatus 110 and to configure it in a low-cost way. The grinding mechanism of the comminuting device 144 and the mixing device 158 can be driven in the same direction of rotation or, alternatively, in different directions of rotation. Operation with a direction of rotation which is reversed at regular intervals or in a manner controlled as required can also be possible. By means of the latter configuration, it is possible, in particular, to remove blockages in the gap 114 and/or in the screening disk.

The drive motor 180 can be configured fully or partially as an electric motor, for example. The drive 178 can have a reduction gear, for example, in the form of the V-belt drive with the V-belt 182 and the driving pulley 184. Fundamentally, this results in less noise and an overload safeguard. The rated speed of the comminuting device 144, i.e. of the grinding mechanism, can be 1000 rpm, for example.

The pump 200 described above can be configured as an impeller pump, for example. As an alternative or in addition, however, one or more other types of pump can also be used, e.g. peristaltic pumps and/or eccentric screw pumps.

The entire comminuter 124 can be swing-mounted in the basic structure of the disposal apparatus 110, for example. As explained above, this fundamentally results in a significant reduction in noise and vibration in the working environment of the disposal apparatus 110. The entire structure of the disposal apparatus 110 can furthermore be embodied in such a way that all the components are easily accessible, e.g. for maintenance purposes. This can be achieved, for example, by means of the above-described at least one door 140 and/or by means of the panels 114, 116 and 122, some of which are removable. As a result, easy and unhindered access to the interior of the disposal apparatus 110 is possible. The pump 200 can also be constructed and incorporated in such a way, for example, that maintenance work can be carried out easily, if required.

As explained above, it is possible, in particular, for the disposal apparatus 110 to have a loading opening 170. In order to improve the hygiene situation during pauses in operation and to avoid the occurrence of odors, the loading openings 170 and/or the chute 174 can be rinsed out at regular intervals with clean water and/or cleaning fluids, for example. Moreover, the loading opening 170 can be closed by means of a closure, for example, e.g. by means of at least one lockable plug, which is not shown in the figures.

LIST OF REFERENCE SIGNS

110 disposal apparatus
112 external housing
114 front panel
116 side panel
118 top cover
120 stand
122 rear panel
124 comminuter
126 comminuter housing
128 grinding chamber
130 collecting chamber
132 grinding chamber wall
134 grinding chamber housing
136 collecting chamber wall
138 collecting chamber housing
140 common door
142 seal
144 comminuting device
146 impact tool
148 impact members
150 chain
152 hub
154 drive axle
156 shaft seal
158 mixing device
160 blade
162 separating disk
164 separating device
166 loading chamber
168 fines chamber
170 loading opening
172 feed opening
174 chute
176 opening
178 drive
180 drive motor

182 V-belt
184 driving pulley
186 bottom
188 cylinder axis
190 openings
192 bottom
194 collection plate
196 opening
198 closure
200 pump
202 extraction connection piece
204 pipe
205 collecting receptacle
206 level sensor
207 disposal system
208 float switch
210 controller
212 operating element
214 gap

The invention claimed is:

1. A disposal apparatus for disposing of food leftovers, comprising:

at least one comminuter, wherein the comminuter has at least one grinding chamber and at least one collecting chamber, wherein the at least one grinding chamber is connected to the at least one collecting chamber via one or more openings, wherein at least one comminuting device having at least one impact tool for comminuting the food leftovers is arranged in the at least one grinding chamber, wherein, in addition, at least one mixer configured to generate a movement in the food leftovers is arranged in the grinding chamber, wherein the at least one grinding chamber is structured such that the one or more openings are configured to direct comminuted food leftovers from the at least one grinding chamber to the at least one collecting chamber, wherein a housing defines the at least one grinding chamber and the at least one collecting chamber, wherein the at least one collecting chamber at least partially surrounds the at least one grinding chamber, wherein the at least one grinding chamber is divided into at least one loading chamber for receiving un-comminuted food leftovers and at least one fines chamber for receiving fully or partially comminuted food leftovers, wherein the at least one comminuter has at least one separator structured to separate the at least one loading chamber and the at least one fines chamber, wherein the at least one separator is structured to permit only food leftovers of a predetermined maximum size to pass through the at least one separator, wherein the at least one impact tool, the at least one mixer and the at least one separator are mounted on a common drive axle, and wherein the at least one impact tool comprises a plurality of chains connected to a hub.

2. The disposal apparatus as claimed in claim 1, wherein the at least one impact tool is flexible.

3. The disposal apparatus as claimed in claim 1, wherein the at least one comminuting device and the at least one mixer are driven by a common drive.

4. The disposal apparatus as claimed in claim 1, wherein the at least one impact tool and the at least one mixer are arranged axially spaced apart on the common drive axle.

5. The disposal apparatus as claimed in claim 1, wherein the at least one mixer is configured to generate a flow in the food leftovers.

6. The disposal apparatus as claimed in claim 1, wherein the at least one comminuting device is arranged fully or partially in the at least one loading chamber or between the at least one loading chamber and the at least one fines chamber.

7. The disposal apparatus as claimed in claim 1, wherein the at least one mixer is arranged fully or partially in the at least one fines chamber.

8. The disposal apparatus as claimed in claim 1, wherein the at least one separator is one of a separating disk or a screen.

9. The disposal apparatus as claimed in claim 1, wherein the at least one fines chamber is arranged in such a way relative to the at least one loading chamber that comminuted food leftovers are moved from the at least one loading chamber into the at least one fines chamber under the action of gravity.

10. The disposal apparatus as claimed in claim 1, wherein a bottom of the at least one grinding chamber slopes by an angle relative to a horizontal.

11. The disposal apparatus as claimed in claim 1, further comprising:

at least one pump for pumping comminuted food leftovers out of the at least one collecting chamber.

12. The disposal apparatus as claimed in claim 1, further comprising:

at least one level sensor for detecting at least one level of comminuted food leftovers in the at least one collecting chamber.

13. The disposal apparatus as claimed in claim 1, wherein the at least one collecting chamber at least partially surrounds the at least one grinding chamber such that an interspace forming the at least one collecting chamber is provided in the housing between the at least one grinding chamber and a wall of the housing.

14. A disposal system for disposing of food leftovers, comprising:

the disposal apparatus as claimed in claim 1, and at least one collecting receptacle for receiving comminuted food leftovers, said receptacle being connected or connectable to the disposal apparatus.

15. A method for disposing of food leftovers, comprising:

loading at least one comminuter with the food leftovers, wherein the comminuter has at least one grinding chamber and at least one collecting chamber, wherein the at least one grinding chamber is connected to the at least one collecting chamber via one or more openings, wherein the loading comprises feeding the food leftovers to the at least one grinding chamber, comminuting the food leftovers in the at least one grinding chamber by at least one impact tool, and at least one process of generating a movement in the food leftovers by at least one mixer in the at least one grinding chamber, wherein the at least one grinding chamber is structured such that the one or more openings are configured to direct comminuted food leftovers from the at least one grinding chamber to the at least one collecting chamber, wherein a housing defines the at least one grinding chamber and the at least one collecting chamber, wherein the at least one collecting chamber at least partially surrounds the at least one grinding chamber, wherein the at least one grinding chamber is divided into at least one loading chamber for receiving un-comminuted food leftovers and at least one fines chamber for receiving fully or partially comminuted food leftovers, wherein the at least one comminuter has at least one separator structured to separate the at least one loading chamber and the at least one fines chamber, wherein the at least one separator is structured to permit only food leftovers of a predetermined maximum size to pass through the at least one separator, wherein the at least one impact tool, the at least one mixer and the at least one separator are mounted on a common drive axle, and wherein the at least one impact tool comprises a plurality of chains connected to a hub.

16. The disposal apparatus as claimed in claim 1, wherein the at least one grinding chamber comprises at least one grinding chamber wall, and wherein the one or more openings comprise a plurality of openings provided as through holes in the at least one grinding chamber wall to allow the comminuted food leftovers to pass from the at least one grinding chamber into the at least one collecting chamber through the plurality of openings.

17. The disposal apparatus as claimed in claim 16, wherein the plurality of openings form a screen.

* * * * *